US008460075B2

(12) United States Patent
Mavroudis et al.

(10) Patent No.: US 8,460,075 B2
(45) Date of Patent: Jun. 11, 2013

(54) COVER FOR WALL AIR CONDITIONING VENT

(75) Inventors: Tom Mavroudis, Massapequa, NY (US); Bill Caporale, Massapequa Park, NY (US)

(73) Assignees: Thomas Mavroudis, Massapequa, NY (US); William Caporale, Massapequa, NY (US)

( * ) Notice: Subject to any disclaimer, the term of this patent is extended or adjusted under 35 U.S.C. 154(b) by 986 days.

(21) Appl. No.: 12/455,773

(22) Filed: Jun. 5, 2009

(65) Prior Publication Data

US 2010/0233953 A1 Sep. 16, 2010

Related U.S. Application Data

(63) Continuation-in-part of application No. 12/381,878, filed on Mar. 16, 2009.

(51) Int. Cl.
*F24F 7/00* (2006.01)

(52) U.S. Cl.
USPC ..... 454/275; 454/307

(58) Field of Classification Search
USPC ..... 454/276, 275, 307
See application file for complete search history.

(56) References Cited

U.S. PATENT DOCUMENTS

| | | | |
|---|---|---|---|
| 510,884 | A | 12/1893 | Bradley |
| 716,450 | A | 12/1902 | Maloney |
| 2,230,203 | A | 1/1941 | Ludwig et al. |
| 2,369,119 | A | 2/1945 | Dauphinee |
| 2,558,421 | A | 6/1951 | Daninhirsch |
| 2,858,760 | A | 11/1958 | Lathrop |
| 2,959,832 | A | 11/1960 | Baermann |
| 3,845,983 | A | 11/1974 | Heintz |
| 3,894,527 | A | 7/1975 | Ickes |
| 4,106,399 | A | 8/1978 | Lawrence |
| 4,130,966 | A | 12/1978 | Kujawa et al. |
| 4,182,227 | A | 1/1980 | Roy |
| 4,201,122 | A | 5/1980 | Maciag |
| 4,325,229 | A | 4/1982 | Dezurik |
| 4,469,018 | A | 9/1984 | Taulman |
| 4,625,784 | A | 12/1986 | Boroson |
| 4,693,174 | A | 9/1987 | Anderson |
| 4,759,194 | A | 7/1988 | Shapiro |
| 4,788,805 | A | 12/1988 | Shaw |

(Continued)

FOREIGN PATENT DOCUMENTS

| | | |
|---|---|---|
| EP | 1310743 | 5/2003 |
| EP | 1316760 | 6/2003 |
| EP | 1326054 | 7/2003 |

*Primary Examiner* — Steven B McAllister
*Assistant Examiner* — Samantha Miller
(74) *Attorney, Agent, or Firm* — Limin Wen

(57) ABSTRACT

An assembly for covering a grill of an air conditioning unit that fits through a wall comprises a rigid or semi-rigid cover having a top, a perimeter flange to which a flexible sealing material is affixed, and having sides, the top having four corner apertures for insertion of the cords. Four elastic cords have a hook at one end and having a barrel lock slideably engaged to a second end. The barrel locks of the elastic cords collectively urge the cover against the wall so as to create an air-tight seal between the cover and the wall. The cover is urged against the wall and prevents unwanted upward hot air flow and downward cold air flow in the winter when the air conditioning system is not in use.

2 Claims, 24 Drawing Sheets

U.S. PATENT DOCUMENTS 5,054,377 A 10/1991 Mochel et al.
5,081,914 A 1/1992 Mejia
5,125,197 A 6/1992 Fuchs
D355,354 S 2/1995 Sterling
5,479,984 A 1/1996 Easterbrook
5,525,145 A 6/1996 Hodge
5,561,952 A 10/1996 Damron
5,658,196 A * 8/1997 Swaim ..... 454/300
5,724,701 A 3/1998 Jones
D394,901 S 6/1998 Governale et al.
5,876,282 A 3/1999 Kenny
5,937,073 A * 8/1999 Van Gieson ..... 381/391
5,966,773 A 10/1999 Jones
6,035,484 A 3/2000 Jones
6,061,981 A 5/2000 Nieves
6,149,514 A 11/2000 Murray
6,261,174 B1 7/2001 Kuehn
6,916,240 B1 7/2005 Morton
6,978,803 B2 12/2005 Brown et al.
7,422,273 B2 9/2008 Varga
2003/0134587 A1 7/2003 Hunter
2008/0160904 A1 * 7/2008 Yi et al. ..... 454/309

* cited by examiner

COVER FOR WALL AIR CONDITIONING VENT

PRIORITY INFORMATION

This patent application claims priority from and is a continuation-in-part patent application of U.S. patent application Ser. No. 12/381,878 previously filed by Applicants and inventors Tom Mavroudis and Bill Caporale on Mar. 16, 2009 which is incorporated herein by reference in its entirety.

BACKGROUND OF THE INVENTION

The present invention generally relates to apparatus and methods for covering vents in wall air conditioners and, more particularly, to apparatus and methods of sealing off a vent used for a central air conditioning system from an indoor environment while the indoor environment is being heated with a separate central or other heating system.

For homes or other environments in which a central air condition system is used to control the environment during the summer and a separate heating system is used to heat the environment during the winter, a problem arises during the season in which the air conditioning vent is not in use and the heating system is being used. During that time, the ceiling vents for the central air conditioning system are not air tight and the attic of a home is never sealed off from outside air. As a result, ducts and air-conditioning system components such as ductwork, duct distribution manifold, and air handler/blower units that may be located in the attic are exposed to cold air from outside. Consequently, when hot air produced by the separate heating system rises, travels though the central air conditioner vents and then travels into and through the cold ductwork and air handler of the air conditioning system in the attic, this hot air is cooled into cold air. This cold air then drops and is re-distributed through the vents in the house, which is manifested by a cool breeze emanating from these vents. This causes a loss of energy in that more heating is necessary to heat the living space.

In addition, the relatively hot air that rises into the cold air ducts also tends to be moist. The moisture in the warm air will condense on the cold ducts. Condensation in the air ducts can cause mold to form. Moisture will also condense and then freeze on the air handling unit causing microscopic cracks in refrigerant coil. This in turn yields leakage of refrigerant and necessitates a service call to be generated to fix the problem when it is discovered.

Prior art covers for the air vents are magnetic, in which case they are useless for the majority of grills which tend to be made of non-metallic components. Other prior art covers for the air vents are shaped for only particular sizes of vents.

As can be seen, there is a need for a method and apparatus for sealing any kind or shape of air conditioning vent.

SUMMARY OF THE PRESENT INVENTION

In one aspect of the present invention, there is presented an assembly for covering a grill of an air conditioning vent, comprising a cover; and a cord having a looped end and a free end, the looped end being of adjustable size and having two hooks slideably connected to the cord, the hooks configured to attach to the grill, the cord being elastic so that pulling the free end of the cord tightens the looped end and the hooks, the free end attached to the cover so that sliding a bottom element up the cord from below the cover urges the cover against a vent area.

In a further aspect of the invention, there is presented a method of sealing an air conditioning vent, comprising attaching a first hook adjoining a looped end of an elastic cord onto a first side of a grill of the vent; attaching a second hook adjoining the looped end of the elastic cord onto a second side of the grill, the second side opposite the first side; inserting a free end of the elastic cord through an aperture in a vent cover; covering the air conditioning vent with the vent cover; and sealing the vent cover.

In a still further aspect of the present invention, there is presented an assembly for covering a grill of a central air conditioning vent, comprising an elastic cord having a looped end and a free end, the looped end being of adjustable size and having two attachment elements slideably connected to the cord, the attachment elements configured to attach to the grill; and a cover having a rigid or semi-rigid frame, the frame having a top and sides, the top having at least one aperture for insertion of the cord, the sides having a perimeter to which a flexible sealing material is attached, the sides of the frame rising along a generally perpendicular step and then further rising to a top of the frame along a line inclined at an approximately 45 degree angle with the top; the free end of the elastic cord extending through the aperture and fitted with a lock.

In a still further aspect of the present invention, there is presented an assembly for covering a central air conditioning vent, the vent having a grill, the assembly comprising an elastic cord having a hook at a free end, the hook configured to attach to the grill; and a cover having a rigid or semi-rigid frame, the frame having a top and sides, the top having at least one aperture for insertion of the cord, the sides having a perimeter to which a flexible sealing material is attached, the sides of the frame rising from the perimeter along a generally perpendicular step and then further rising to the top along a line inclined at an approximately 45 degree angle with the top; the free end of the elastic cord extending through the aperture and fitted with a lock.

In a further aspect of the present invention, there is presented an assembly for covering a vent of an air conditioning unit, the air conditioning unit fitted through a wall, the assembly comprising fastening structures that can be attached securely to the wall; elastic cords, each elastic cord having a hook attachable to one of the fastening structures and having a free end; and a rigid or semi-rigid cover having a perimeter flange to which a flexible sealing material is affixed, the cover having a top and sides, the top having four corner apertures for insertion of the cords, the free end of each elastic cord extending through the aperture and fitted with a lock that holds the cord sufficiently tight that the cover is urged against the wall.

In a further aspect of the invention, there is presented a method of sealing an air conditioning vent for an air conditioning unit that fits into a wall of a building structure, comprising attaching fastening structures to the wall, the fastening structures having apertures; attaching hooks to each of the fastening structures, the hooks situated at proximal ends of elastic cords; inserting a free end of each of the elastic cords through an aperture in a vent cover; covering the air conditioning vent with the vent cover; and sealing the air conditioning vent without adhesive material.

In a still further aspect of the present invention, there is presented an assembly for covering a through-the-wall air conditioner for a wall having fastening structures, the assembly comprising four elastic cords, each having a hook at one end and having a barrel lock at a second end; and a rigid or semi-rigid cover having a perimeter flange to which a flexible sealing material is affixed, having a top and having sides, the top having four corner apertures for insertion of the cords, the barrel locks of the elastic cords collectively urging the cover against the wall so as to create an air-tight seal between the cover and the wall.

These and other features, aspects and advantages of the present invention will become better understood with reference to the following drawings, descriptions and claims.

DETAILED DESCRIPTION OF THE INVENTION

Figure 1A:
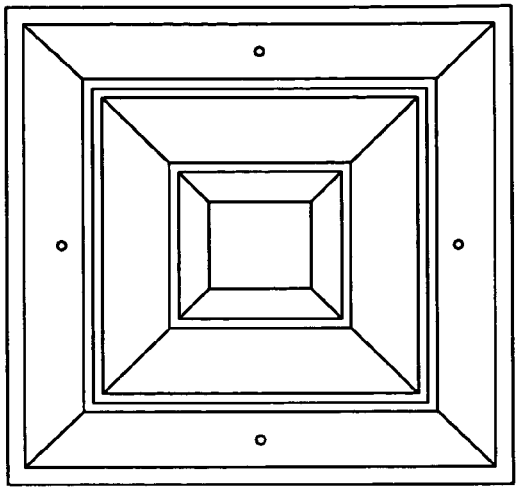
(PRIOR ART) FIG. 1A
FIGS. 1A through 1I are prior art air conditioning grills of various shapes and configurations.
Figure 1B:
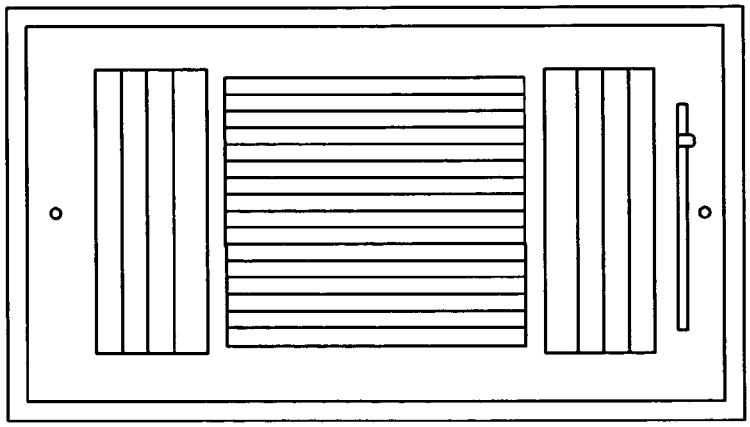
(PRIOR ART) FIG. 1B
Figure 1C:
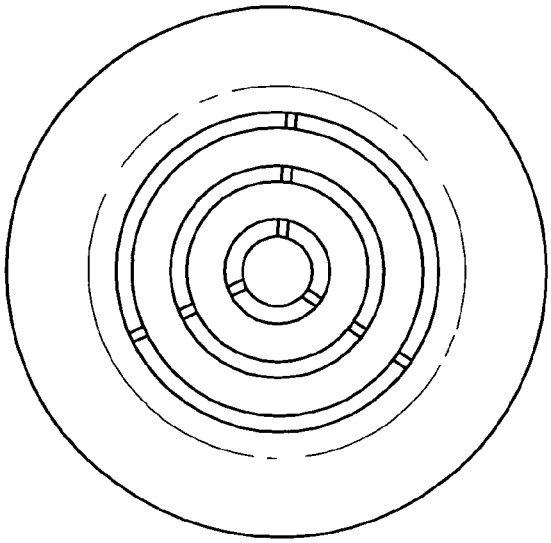
(PRIOR ART) FIG. 1C
Figure 1D:
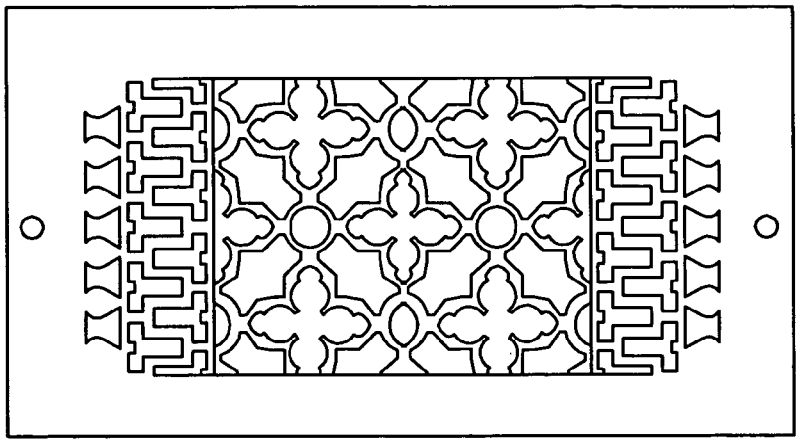
(PRIOR ART) FIG. 1D
Figure 1E:
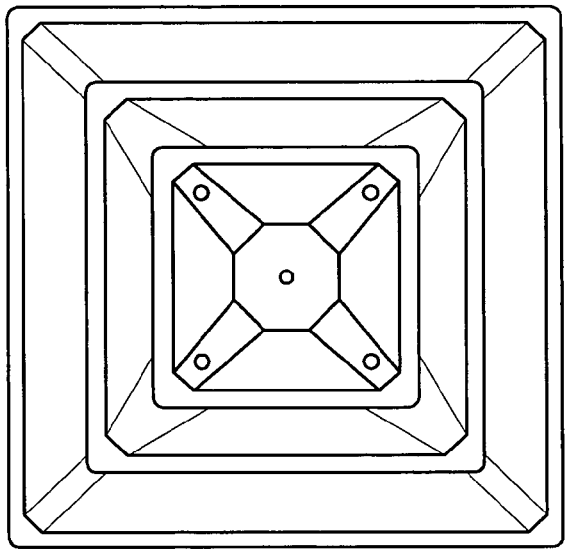
(PRIOR ART) FIG. 1E
Figure 1F:
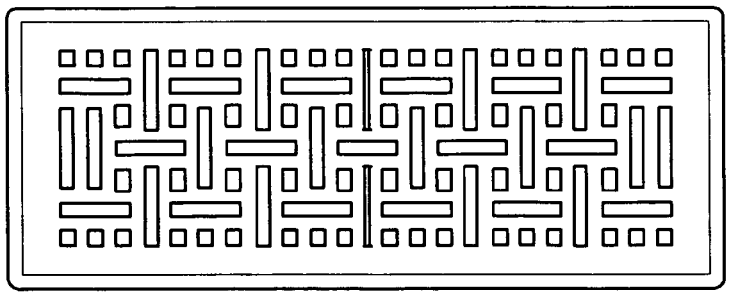
(PRIOR ART) FIG. 1F
Figure 1G:
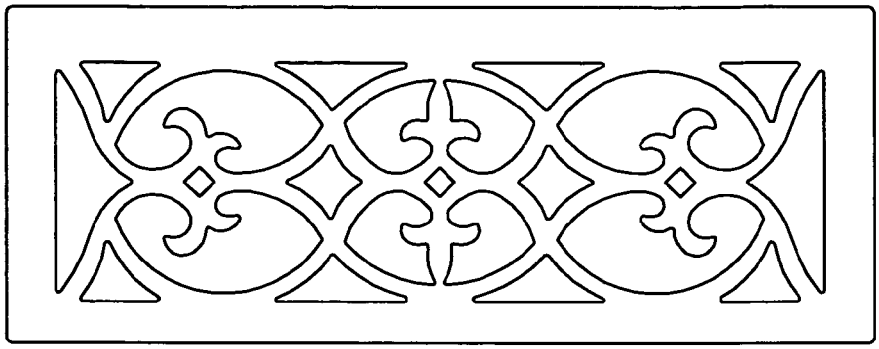
(PRIOR ART) FIG. 1G
Figure 1H:
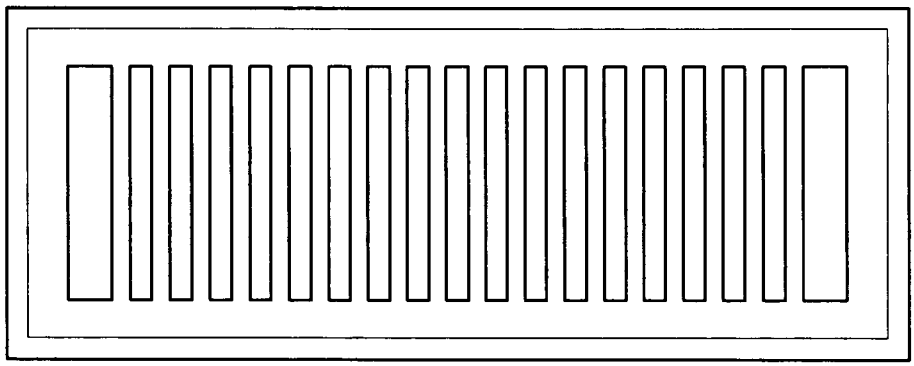
(PRIOR ART) FIG. 1H
Figure 1I:
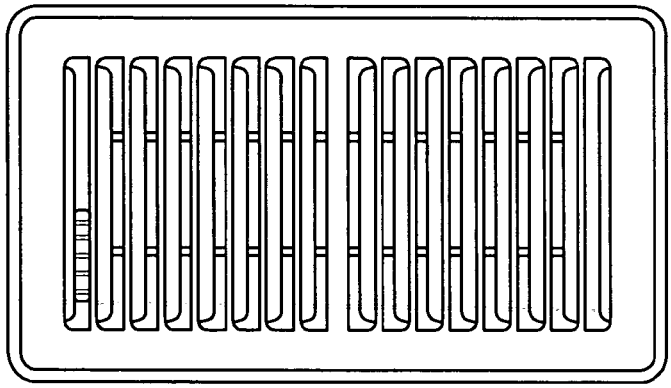
(PRIOR ART) FIG. 1I

The following detailed description is of the best currently contemplated modes of carrying out the invention. The description is not to be taken in a limiting sense, but is made merely for the purpose of illustrating the general principles of the invention, since the scope of the invention is best defined by the appended claims.

The present invention generally provides an assembly for covering the grill of a central air conditioning vent or of a wall air conditioning vent in homes (or offices) having a dual HVAC system during the winter when the air conditioning system is not in use and a separate heating system is being used. The assembly may prevent the relatively hot air in the home (or office) from escaping through the vent to the ducts (in the case of a central air conditioning system) and to prevent cold air from entering the home (or office) through the vent. The assembly may be applicable to environments where heat is not coming through air conditioning ducts. The assembly may include an elastic cord having a looped end with slideably attached hooks that attach to the grill and may include a rigid or semi-rigid cover, for example plastic. The cover may be generally rectangular and may have a compressible material, such as foam, around its perimeter. Following the method of the present invention, the looped end of the elastic cord may be attached to the grill and then tightened by pulling the free end. The free end may be attached to the cover, for example by inserting through a hole in a top part of the cover frame, so that sliding a bottom element such as a barrel lock up the cord from below the cover urges the cover against the vent area around the grill to create an air-tight seal using the compressible material. In a further embodiment for air conditioner units that fit through walls of a building structure, the assembly may comprise four elastic cords that fit through four apertures in the cover. Each elastic cord may have a hook end by which it may attach to screw eyelets or other fastening structures in the wall. Sliding the four barrel locks up the cord from below the cover urges the cover against the wall to create an air-tight seal using the compressible material attached to a perimeter flange of the cover.

In contrast to the prior art, in which covers for air conditioning vents are magnetic and cannot be used for non-metallic grills, the method and assembly of the present invention may not employ magnets and may fit any grill regardless of the material made from. In further contrast to the prior art, in which the cover is designed to fit over grills of a particular size or shape, the method and assembly of the present invention works with any size or shaped grill. In contrast to the prior art in which adhesive or Velcro® is used to attach to the vent area and removing the device when the air conditioning system is needed causes paint around the vent area to be stripped and looks ugly, the method and assembly of the present invention may allow removal of the assembly without leaving any marks or stripping any paint. In further contrast to the prior art, which may require tools or complicated installation and/or removal, the method and assembly of the present invention may seal the air conditioning vent from air flow without any tools and may be installed and removed without constructing anything in a matter of seconds. For example, the installation of the double hook embodiment may occur in approximately 5 seconds, not including sticking the free end into storage for aesthetic reasons. In contrast to prior art devices which do not adequately insulate against air flow, the method and assembly of the present invention may be installed and effectively insulate against air flow and prevent heat loss and associated extra energy costs. In contrast to the prior art devices which are either not effective or have characteristics that dissuade people from using them, the method and apparatus of the present invention may solve the problem of energy loss whose magnitude is quite significant and may save the lost energy.

The following energy loss calculations have been performed. Chu and Gassman, a certified engineering consultant firm relied on by Consolidated Edison and other utility companies for energy calculations was retained by Applicants and concluded that (i) the potential annual energy saved in New York City by covering and sealing around a 12,000 Btuh through-the-wall air conditioner installed in a wall sleeve is 5,170,193 Btu for heating and each house would save $102.91 per year; and (ii) the potential annual energy saved by covering the air outlets from a typical ducted attic air-conditioning system in New York City during the winter is 13,082,283 Btu for heating and each house would save $260.40. based on these calculations, and the effectiveness of the present invention, the method and apparatus of the present invention achieve these savings.

Figure 2:
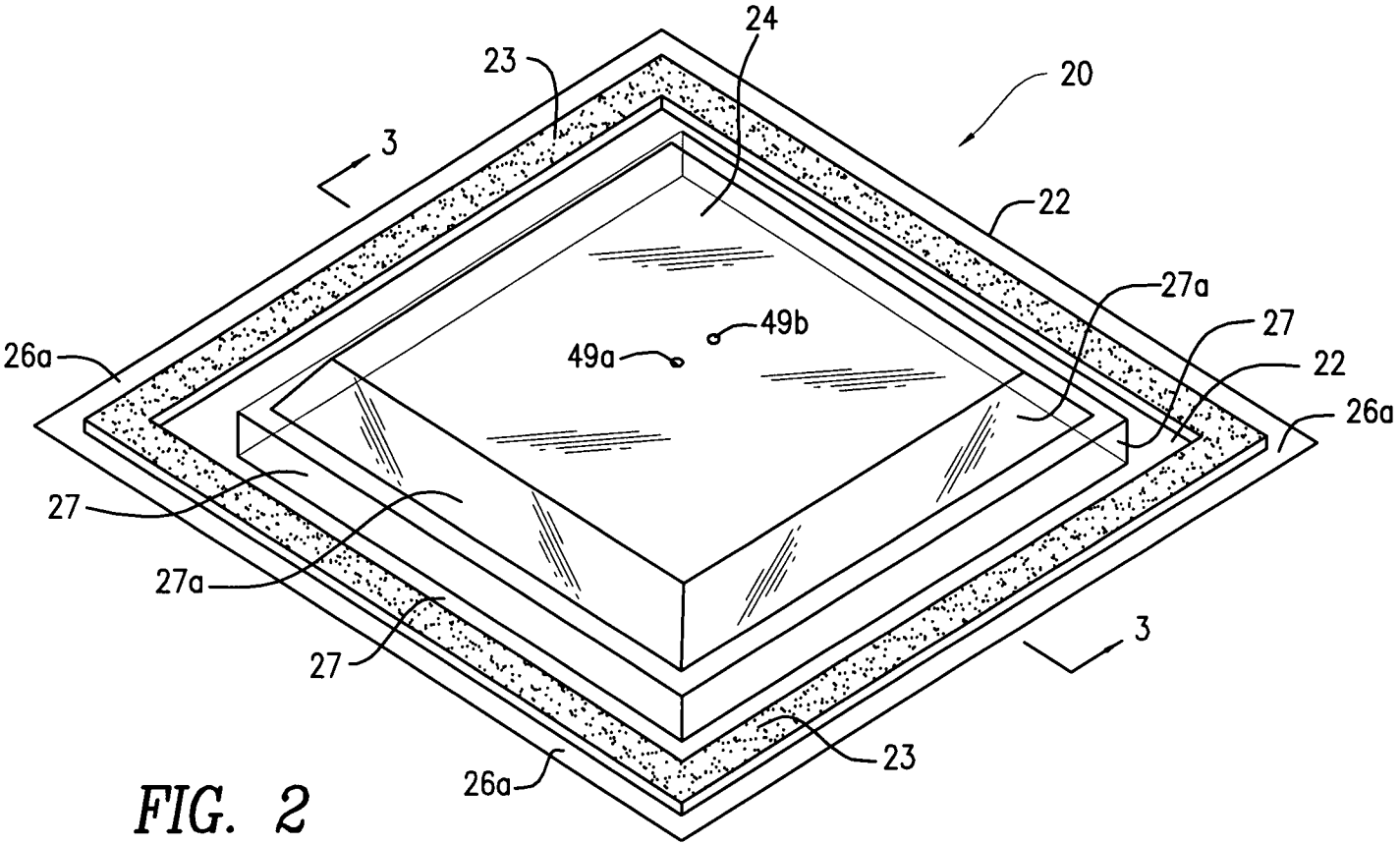
FIG. 2 is a perspective view of a cover of an assembly of the present invention.
Figure 6A:
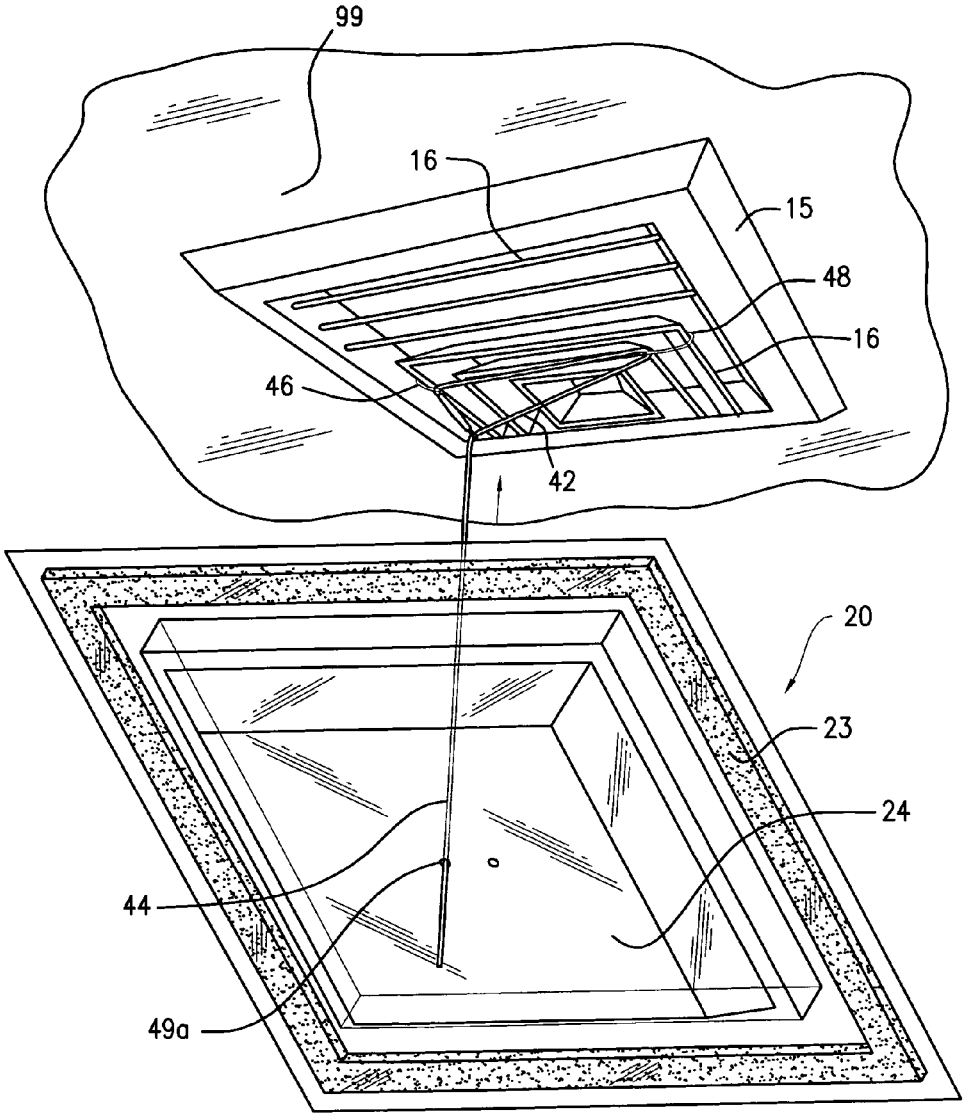
FIG. 6A is a perspective view of the assembly in accordance with one embodiment of the present invention being installed on a ceiling air conditioning vent in accordance with one preferred embodiment of the method of the present invention.
Figure 6B:
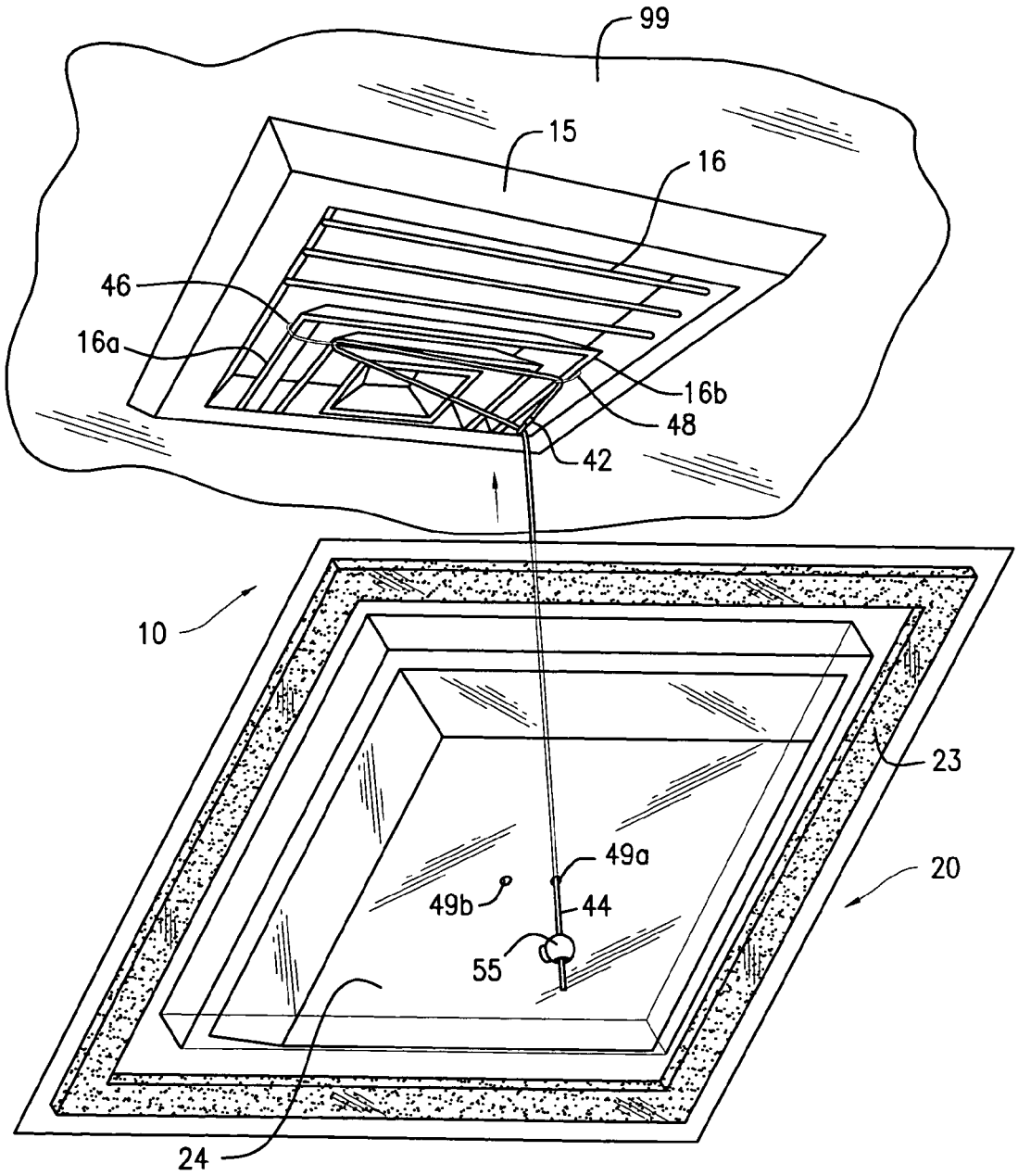
FIG. 6B is a perspective view of the assembly in accordance with one embodiment of the present invention being installed on a ceiling air conditioning vent in accordance with one preferred embodiment of the method of the present invention.

As can be seen from FIG. 2 and from FIG. 6B, an assembly 10 for covering a grill 16 of an air conditioning vent 15 includes a cover 20 having a rigid or semi-rigid frame 22, the frame 22 having a top 24 and sides 26. Top 24 may have two holes for insertion of a cord 30. Sides 26 of frame 22 may have a perimeter 26*a* to which a foam 23 or other compressible material 23 may be attached for contacting the vent area 99 and thereby may override any irregularities in the surface of the vent area 99 and thereby may seal vent cover 20 against vent area 99 when the vent cover 20 may be pressed against vent 15. Compressible material 23 may lie inside a channel carved into perimeter/flange 26*a* although a portion of compressible material 23 may protrude outside the channel, to allow compression of this material 23.

Figure 3:
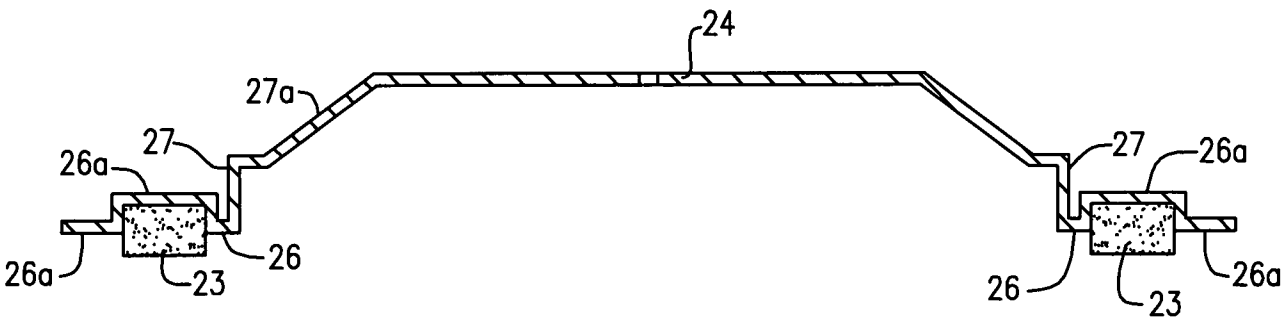
FIG. 3 is a sectional view of FIG. 2 taken along line 3-3.

As seen from FIG. 3, sides 26 of frame 22 may rise along a generally perpendicular step 27 and may then further rise to top 24 of frame 22 along a line 27*a* that may be inclined at an approximately 45 degree angle with top 24. Both step 27 and the inclined line 27*a* add stability to frame 22 and may equalize the distribution of forces exerted from cord 40 and top 24 to flange/perimeter 26*a*. Step 27 and/or inclined line 27*a* may be viewed as part of top 24 or as part of sides 26 of frame 22. Frame 22 may be semi-rigid or rigid, although typically, frame 22 may be rigid with the exception of step 27.

Figure 4:
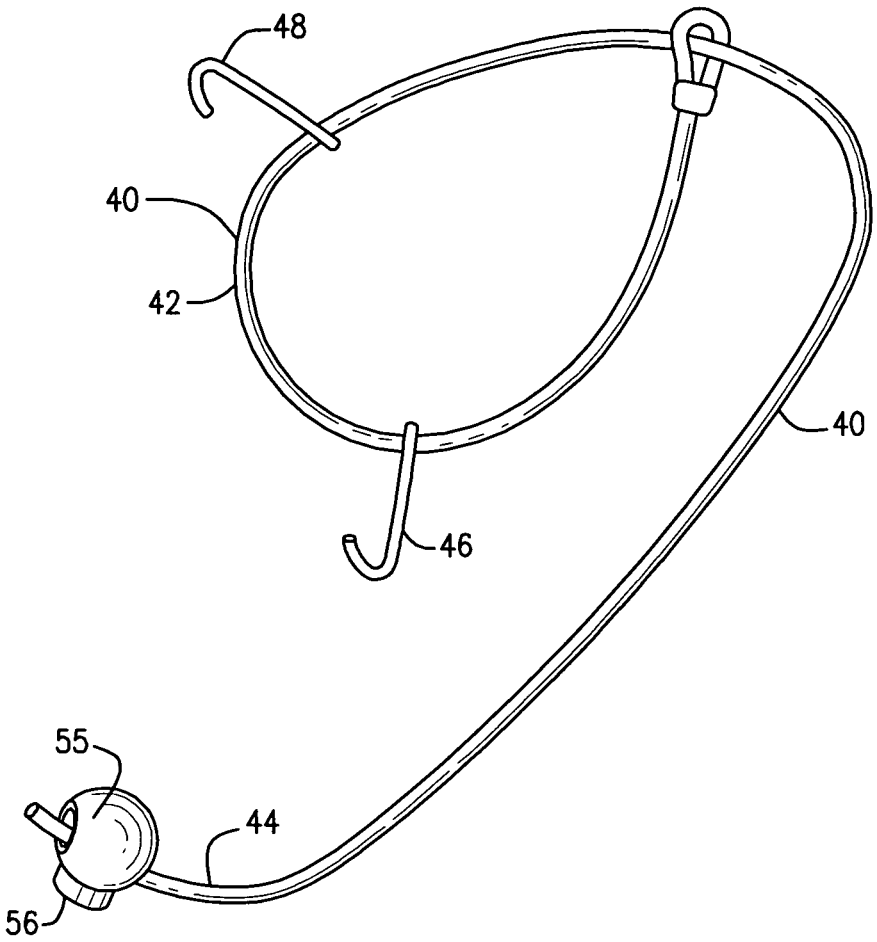
FIG. 4 is a perspective view of an elastic cord, in accordance with a preferred embodiment of the present invention, showing a looped end.

Assembly 10 may also include a cord 40, which may be elastic. As seen from FIG. 4, cord 40 may have a looped end 42 and a free end 44. Looped end 42 may be of adjustable size by adjusting the amount of cord 40 outside the loop. Looped end 42 may also have two hooks 46, 48 slideably connected to the cord. Hooks 46, 48 may be shaped or configured to attach to the grill 16. Significantly, they may be able to attach to any size and shaped grill 16 whether square or round or small or large, as seen from the variety of shapes and sizes and designs seen in prior art FIG. 1A through FIG. 1I.

Figure 5:
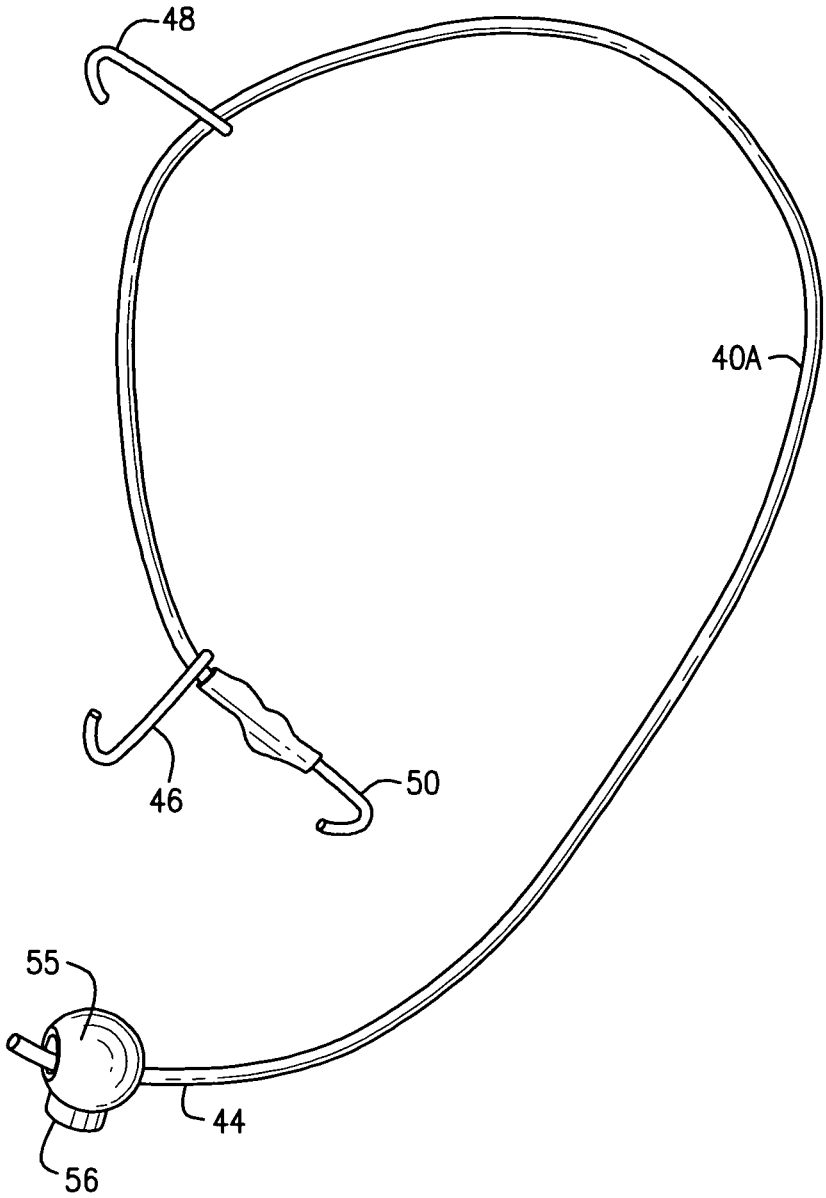
FIG. 5 is a perspective view of an elastic cord, in accordance with an alternative embodiment of the present invention, employing a hook at one end.

FIG. 5 shows an alternative embodiment of cord 40A in which third hook 50 replaces the looped end. Third hook 50 may be used to tighten the hooks 46A, 48A against grill 16. It has been found that while cord 40A may be generally effective, third hook 50, at least as configured in FIG. 5, may be liable to detach and render an assembly utilizing cord 40A comparatively inferior.

Cord 40 may be sufficiently elastic that pulling free end 44 of cord 40 may cause looped end 42 and hooks 46, 48 to tighten around grill 16. Looped end 42 of cord 40 may be sized and configured so that when tightened hooks 46, 48 hold opposite sides of grill 16 firmly as shown in FIGS. 6A, 6B, 7, 8 and 9. This pulling and tightening may occur after free end 44 has been inserted into cover 20. Cord 40 may be made of the kind of elastic material that is similar to a bungee cord.

Figure 7:
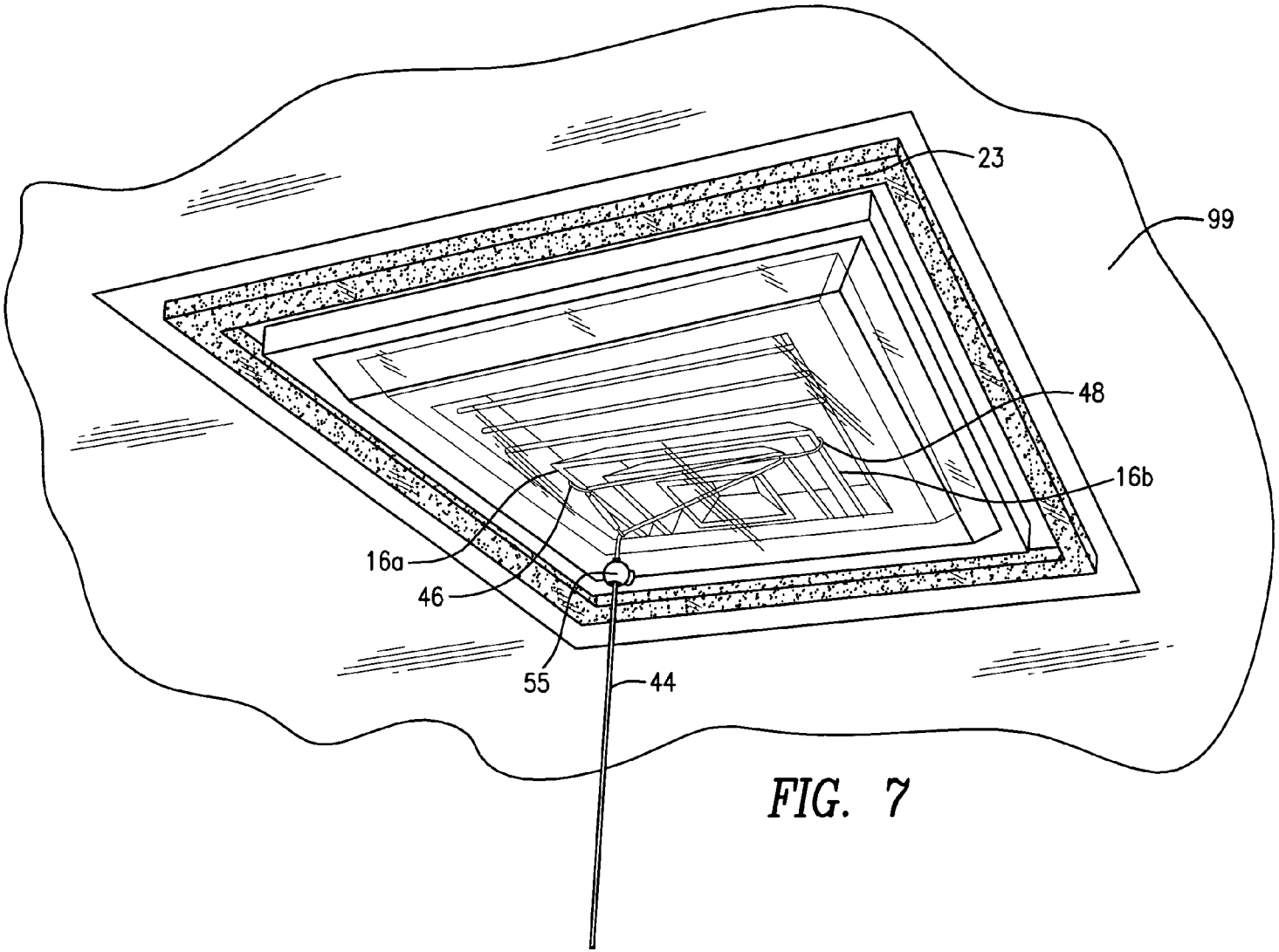
FIG. 7 is a perspective view of the assembly in accordance with one embodiment of the present invention being installed on a ceiling air conditioning vent in accordance with one preferred embodiment of the method of the present invention.
Figure 8:
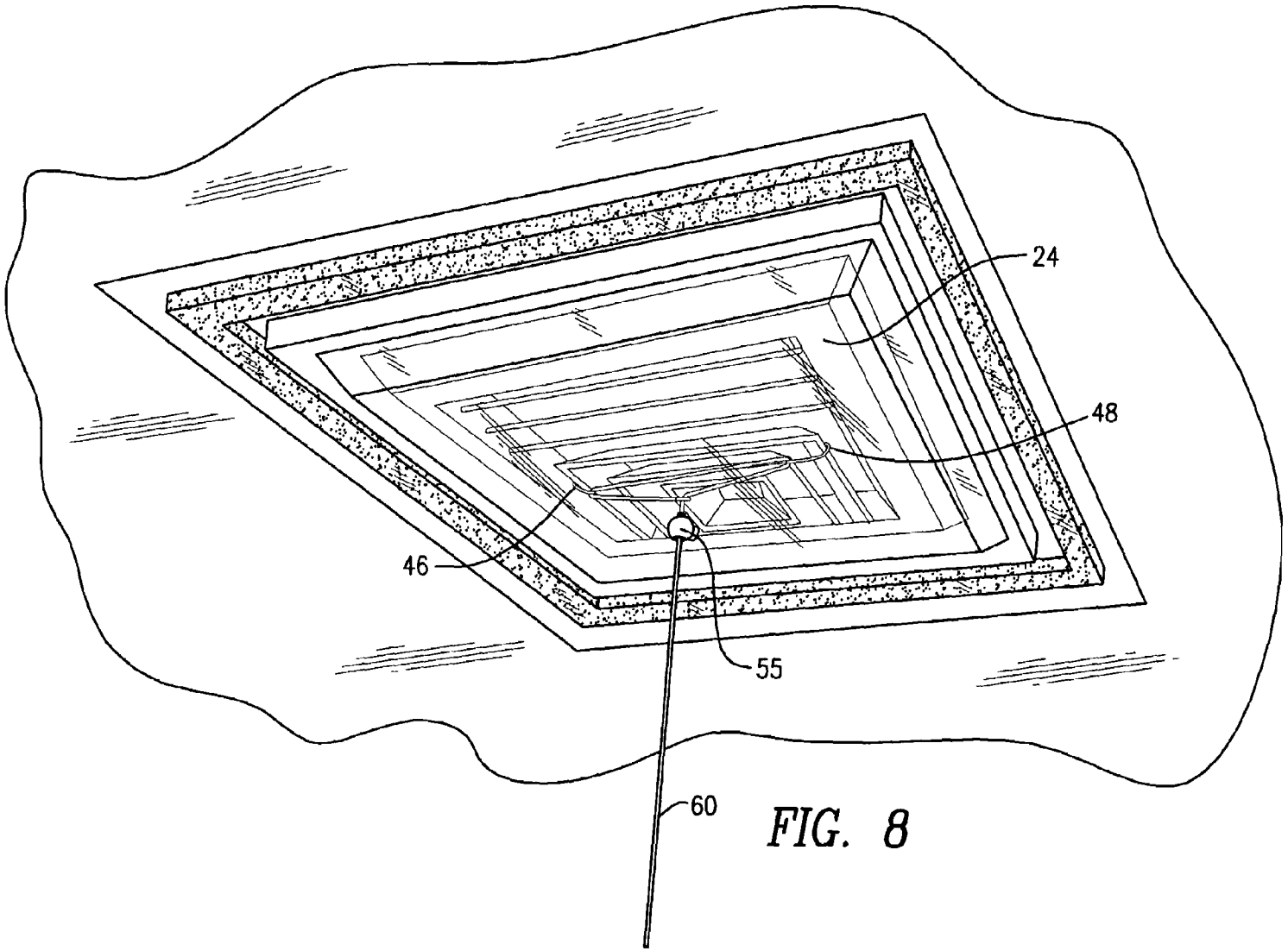
FIG. 8 is a perspective view of the assembly in accordance with one embodiment of the present invention being installed on a ceiling air conditioning vent in accordance with one preferred embodiment of the method of the present invention.
Figure 9:
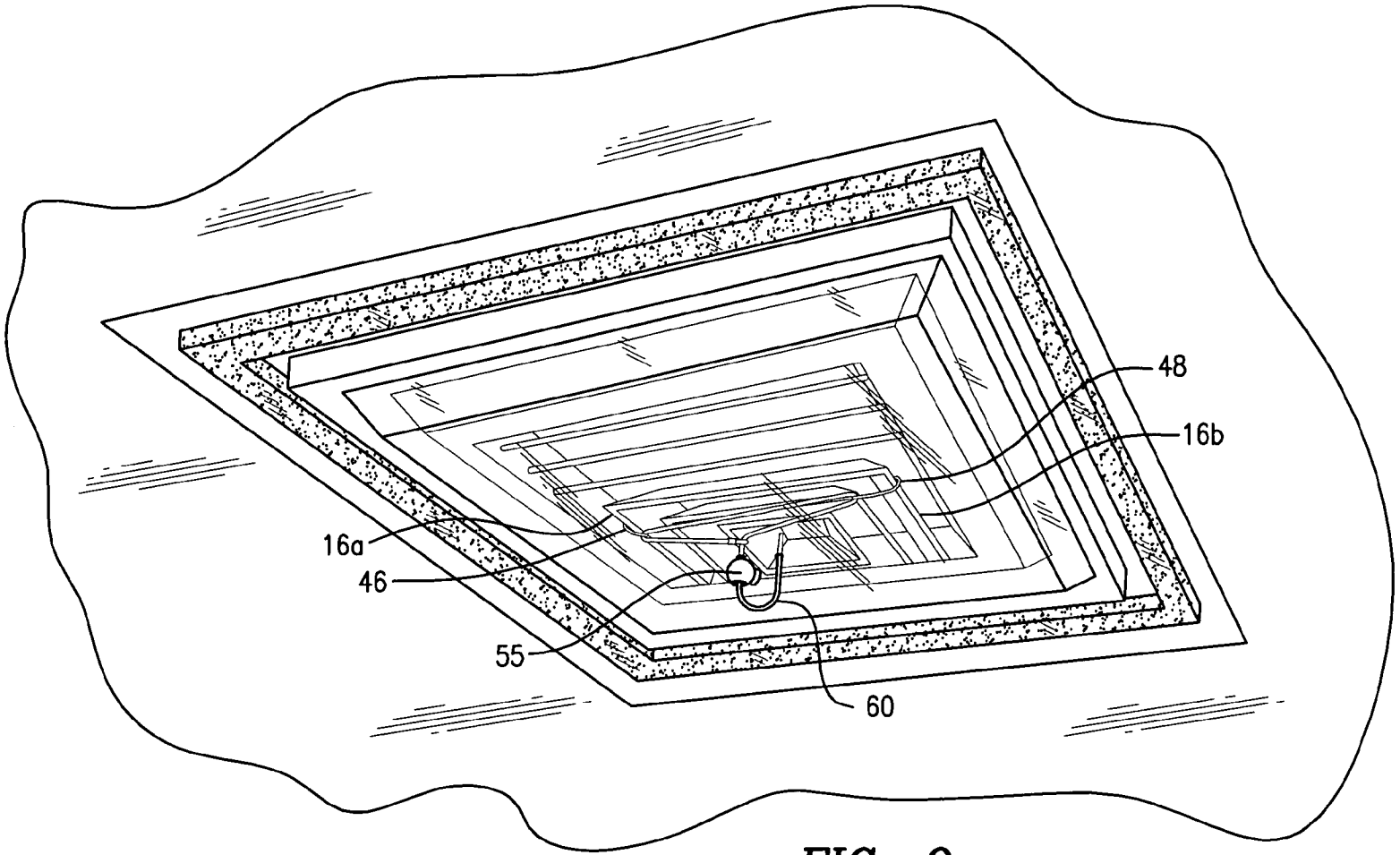
FIG. 9 is a perspective view of the assembly in accordance with one embodiment of the present invention fully installed on a ceiling air conditioning vent in accordance with one preferred embodiment of the method of the present invention.

Free end 44 may be attached to cover 40 in a preferred way shown in FIG. 6 through FIG. 9. When looped end 42 is attached to grill 16 via hooks 46, 48, the remainder of cord 40 may be referred to as the trunk or slack of cord 40. As shown in FIG. 6A, free end 44 may first be slipped through first aperture 49*a* in cover 20 when cover 20 is upside down so that top 24 of cover 20 is facing down. Afterwards, as shown in FIG. 6B, a bottom element 55 such as lock 55, which may be a barrel lock 55 (see FIG. 4), may be fitted onto free end 44. Barrel lock 55 may contain a squeezable element 56 that holds lock 55 to cord 40 whenever squeezable element 56 is not being squeezed. As shown in FIG. 7, lock 55, which may be of larger diameter than aperture 49*a*, may then be slid up the trunk or slack of cord 40 hanging below cover 20 to move cover 20 upward and against vent area 99. At the same time, free end 44 may be pulled downward to tighten hooks 46, 48 around grill 16. After free end 42 has been pulled down and lock 55 has been moved to just below top 24 of cover 20 (when cover is upside down so that top 24 is facing down), the trunk 60 of cord 40 may be centered, as shown in FIG. 8. FIG. 9 shows assembly 10 after the slack 60 below lock 50 is inserted into second aperture 49*b* in cover 20 and away from the user for aesthetic reasons.

Figure 10:
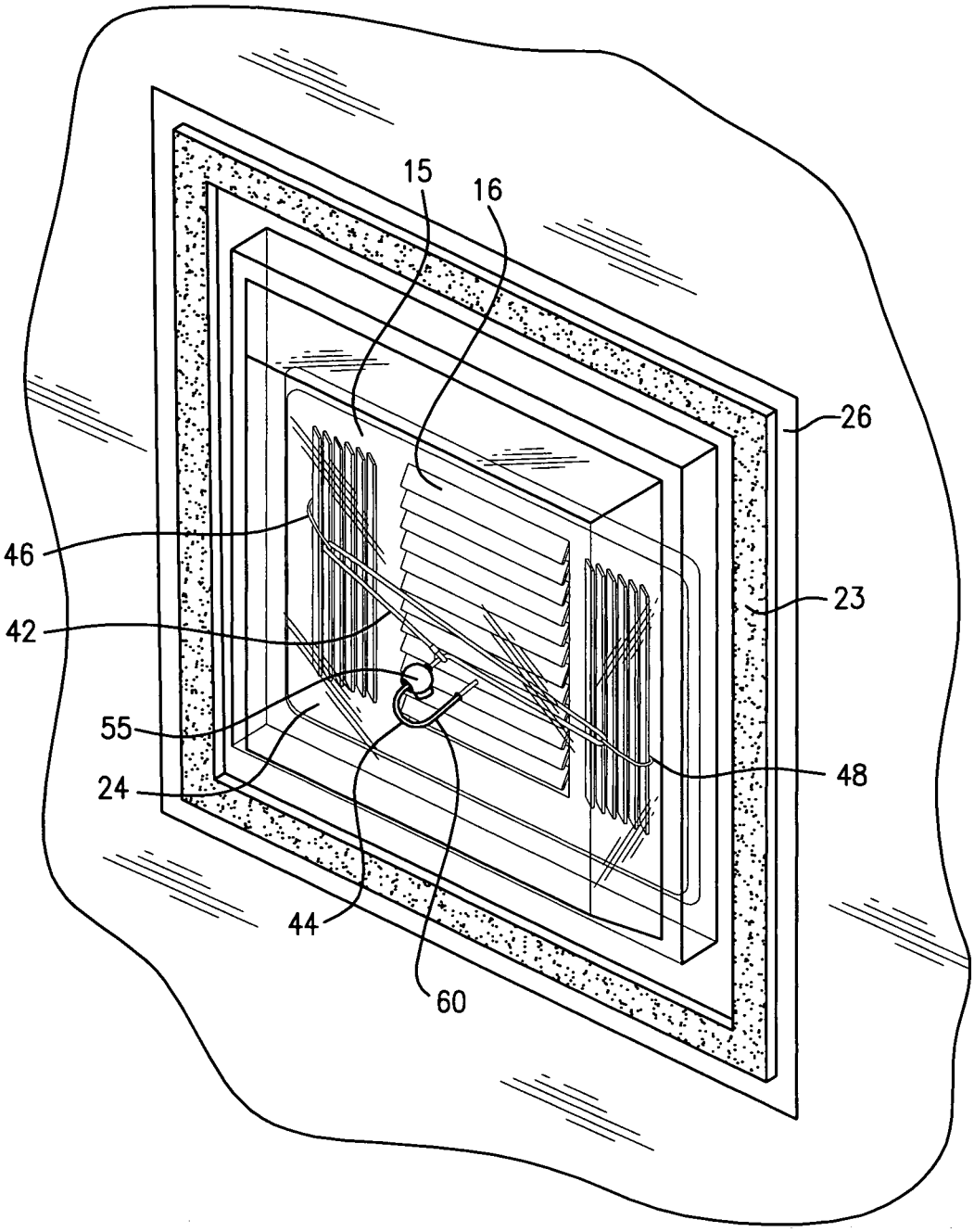
FIG. 10 is a perspective view of the assembly of the present invention installed on a wall air conditioning vent.

FIG. 10 shows assembly 10 installed on a grill 16 of a vent of wall air conditioner.

Although generally cover 20 may be rigid or semi-rigid this not include a compressible sealing element 23. Foam 23 may not be a porous foam that lets air through since foam 23 may be used to create an air-tight seal between cover 20 and vent area 99. Foam 23 or other compressible material may be sufficiently supple to mesh with any ceiling irregularities in vent area 99. As used herein, "vent area" 99 may encompass the area surrounding the vent, such as the ceiling for a ceiling vent and may also encompass a portion of the vent itself, for example an outer perimeter area of the vent surrounding the grill 16, as seen in FIG. 6B. "Adhesive material" as used herein encompasses adhesive and Velcro®.

Figure 11:
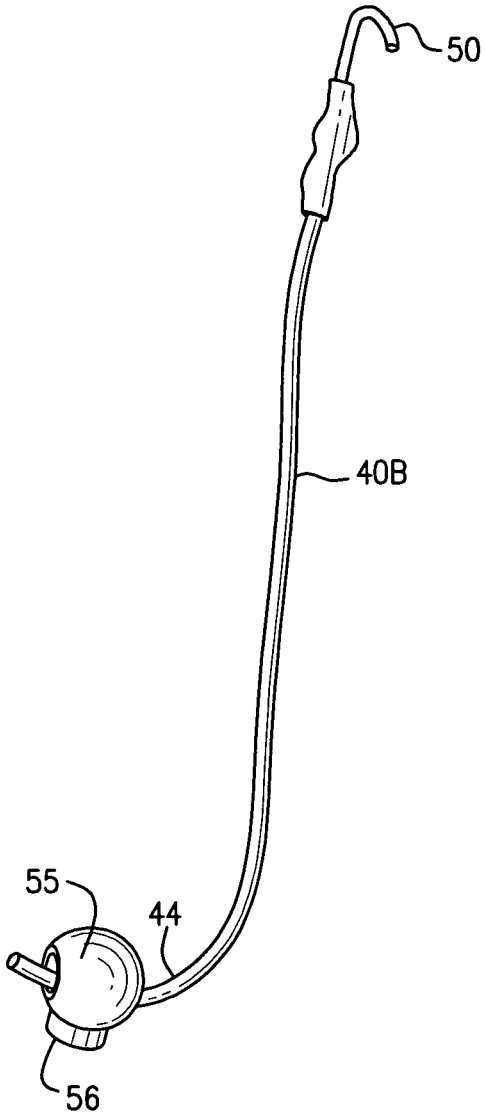
FIG. 11 is a perspective view of a single-hook cord in accordance with one embodiment of the present invention.
Figure 12:
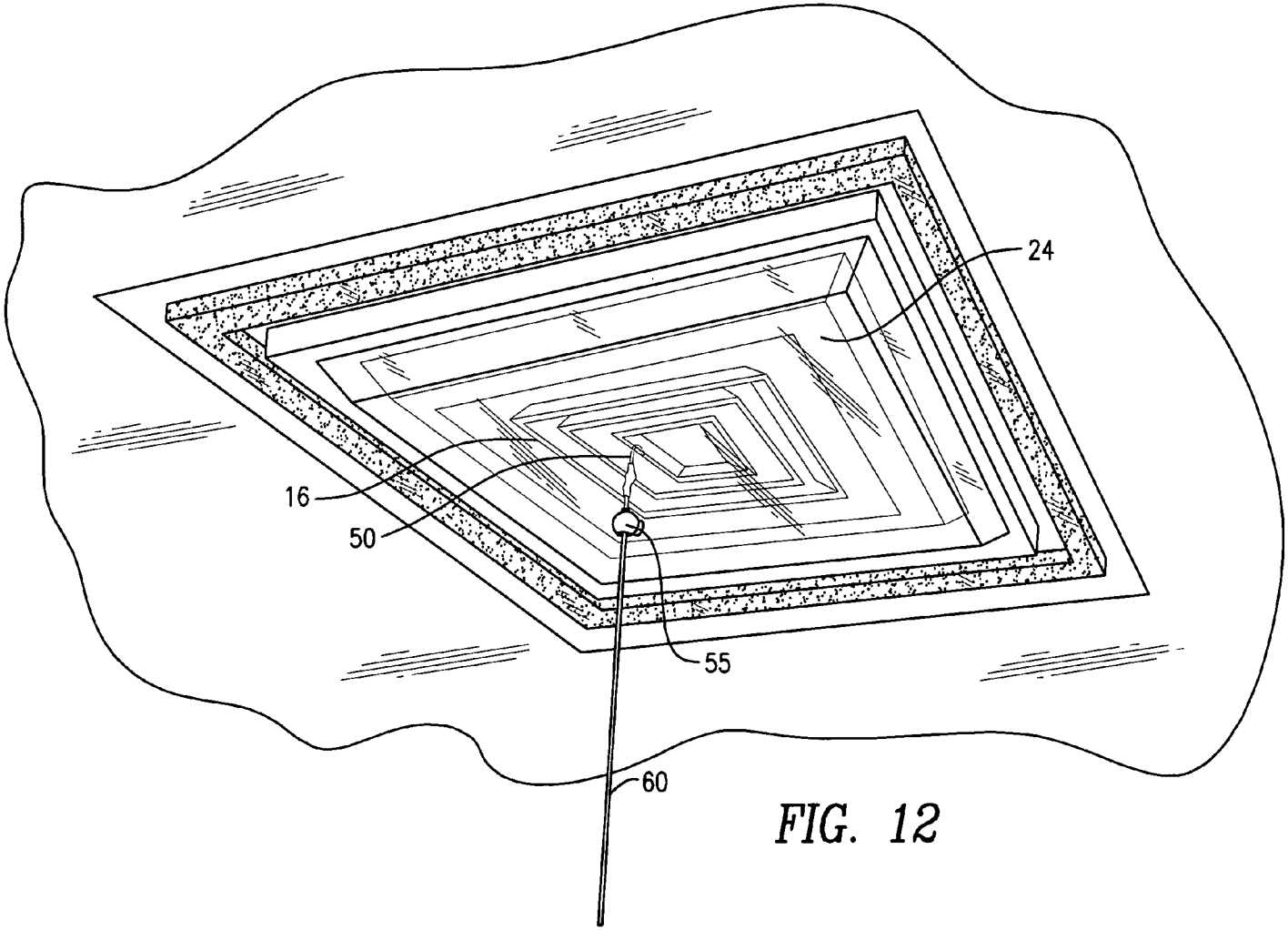
FIG. 12 is a perspective view of the single-hook cord of FIG. 11 incorporated into an assembly of the present invention that is installed on a ceiling air conditioning vent.

As seen in FIG. 11, certain grills 16 may be shaped so as to allow attachment of a single hook onto grill 16 which hook 50 may be positioned directly above an aperture of cover 20. This may occur, for example, where the fins of the grill 16 may be off-center and an edge of one of the fins of the grill 16 may be centered directly above the aperture in cover 20. In this case, it may be possible to use cord 40B with only a single hook 50 at the attaching end, in conjunction with cover 20, as seen in FIG. 11 and FIG. 12. This may require even less time to install, although the single hook version may not be appropriate for certain shaped grills 16. It is also noted that the cord 40A shown in FIG. 5 may also be used with one single active hook for appropriate grills 16 and this may or not be accompanied by removal of hooks 46, 48 (when free end 44 has no lock 55).

The present invention may also be characterized as a method 100 of sealing an air conditioning vent. The air conditioning vent may be a ceiling central air conditioning vent or a wall air conditioner. Method 100 may include a step 110 of attaching a first hook 46 adjoining a looped end 42 of an elastic cord 40 onto a first side 16*a* of a grill 16 of the vent 11. Method 100 may further include a step 120 of attaching a second hook 48 adjoining the looped end 42 of the elastic cord 40 onto a second side 16*b* of grill 16. Typically, second side 16*b* may be located opposite first side 16*a*.

Method 100 may further include a step 130 of inserting a free end of the elastic cord 40 through an aperture 49*a* in the vent cover 20. Method 100 may also include a step 140 of covering the air conditioning vent with the vent cover. Covering the air conditioning vent with the vent cover may be carried out by sliding a lock along the free end to urge the vent cover against a vent area adjacent the air conditioning vent. Method 100 may also further comprise tightening the first and second hooks to the grill by pulling the free end of the elastic cord. Method 100 may further include a step 150 of sealing the air conditioning vent without adhesive material. The step 150 of sealing the air conditioning vent may comprise pressing the vent cover 20 against the vent area to create an air tight seal using a compressible material around the vent cover. The steps 140 and 150 of covering the air conditioning vent with the vent cover and sealing the vent cover by pulling the free end of the elastic cord may be carried out in one motion. Method 100 may also include sliding a barrel lock up the free end to urge the vent cover against a vent area adjacent the air conditioning vent. After the heating season, when the air conditioning vent is needed for keeping the environment cool, the user may remove the vent cover from the air conditioning vent by releasing the lock 50, slipping lock 50 off free end 44 and allowing the vent cover's weight to let it move from the vent area which can be done without stripping any paint from the vent area 99. Method 100 may be performed whether or not the air conditioning vent 15 is made from metal.

Figure 13:
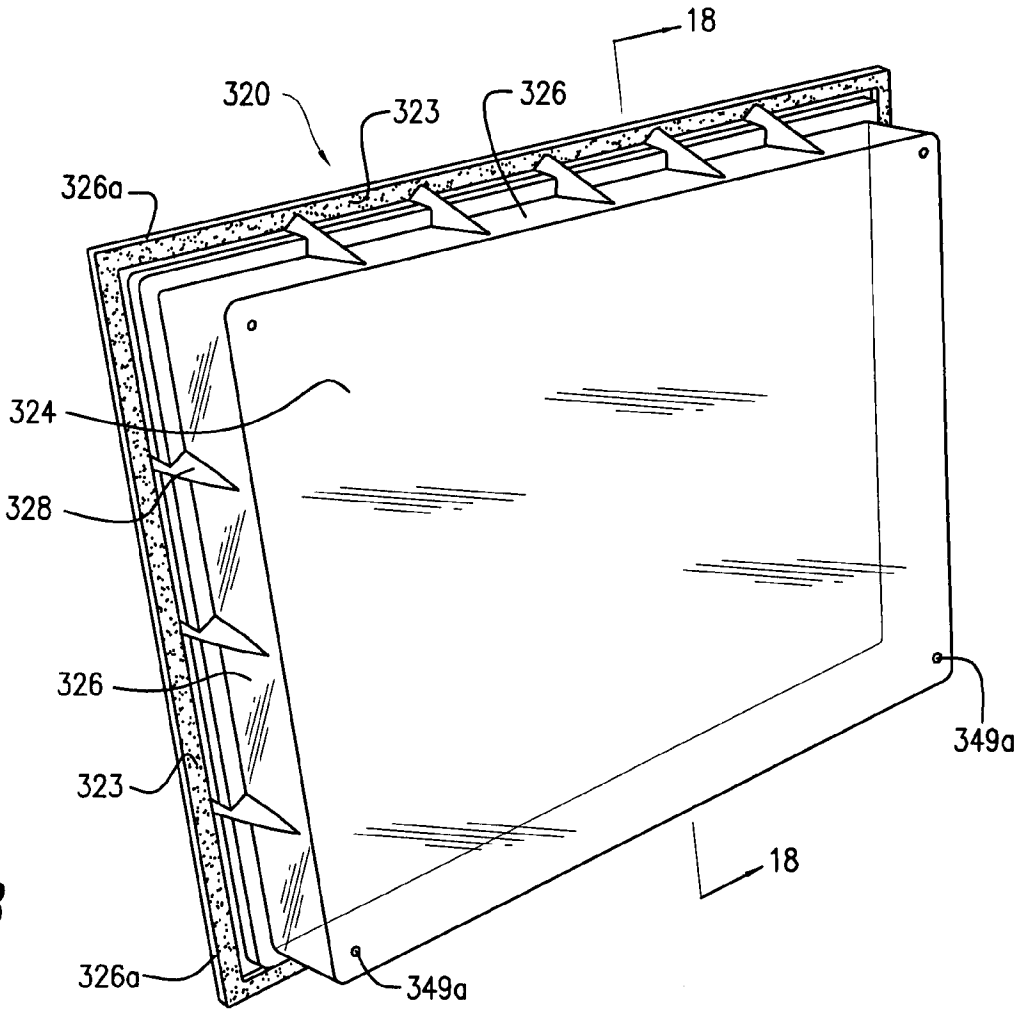
FIG. 13 is a perspective view of a cover for an assembly of the present invention for wall air conditioners.

As seen from FIG. 13, an alternative assembly 310 may be used for covering an air conditioning vent 315 of a wall air conditioning unit 319 that fits through a wall of a building structure. Assembly 310 may include a cover 320 having a rigid or semi-rigid frame and may have a top 324, sides 326 and a perimeter flange 326*a* to which a flexible sealing material 323 may be attached. Cover 320 may be similar to cover 20 of assembly 10 in thickness and material. As seen from FIG. 14, sides 326 of cover 320 may be boxy and may rise along a generally perpendicular step 327. For additional stability and durability, sides 326 may include gussets 328, whose number may vary.

Figure 17:
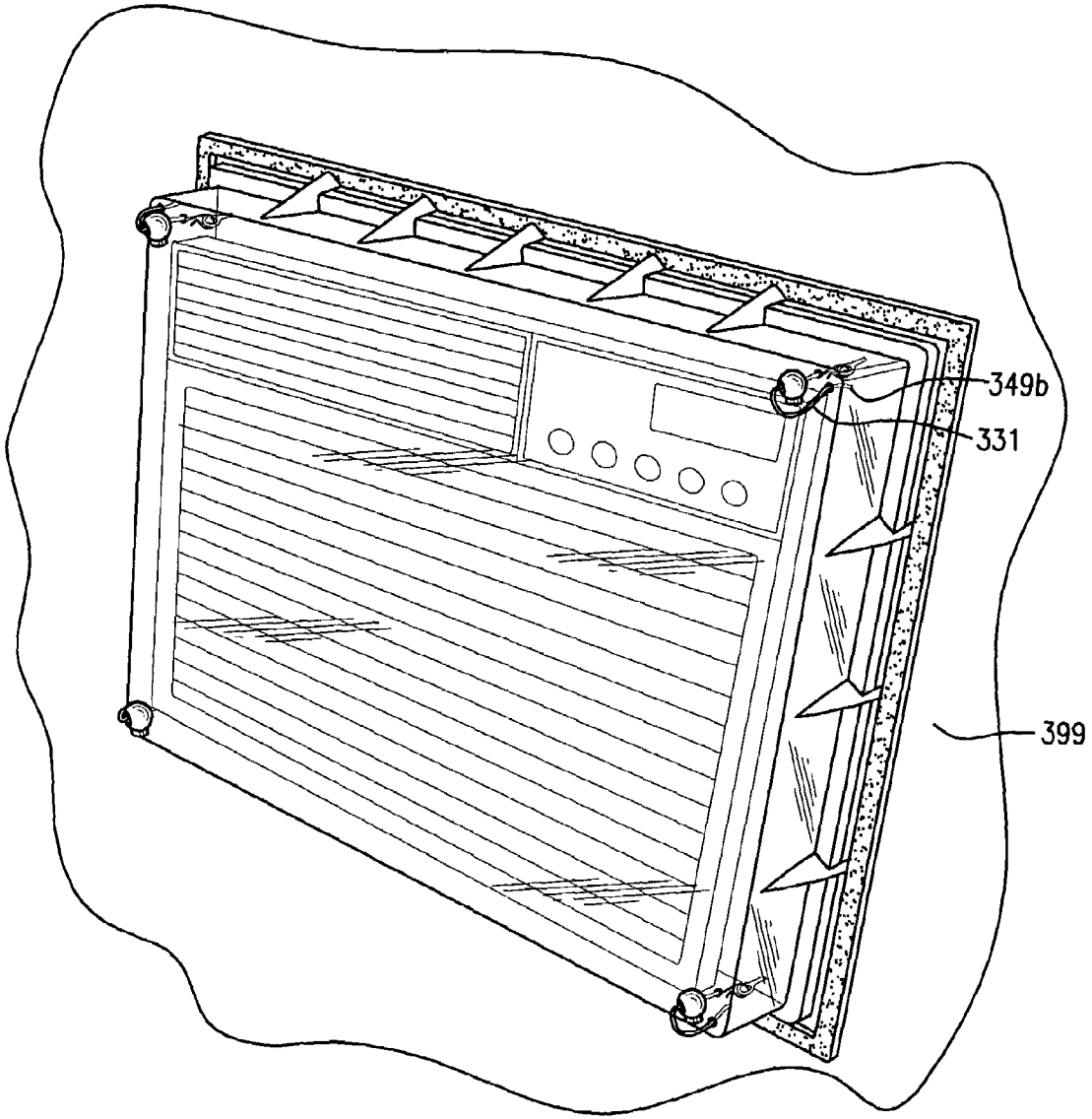
FIG. 17 is a perspective view showing the assembly of FIG. 15 fully installed on a wall air conditioner.

Top 324 of cover 320 may include multiple apertures 349*a* for insertion of a cord 330. Apertures 349*a* may preferably be situated at corners of cover 320 and in one embodiment may number a total of four. In other embodiments, apertures 349*a* may number a total of eight or another number. This does not include secondary apertures 349*b* since as seen from FIG. 17, cover 320 may also include a like number of secondary apertures 349*b* sized to receive the slack 331, i.e. the portion of elastic cords 330 from the free ends 333 of each of the elastic cords 330 up to the bottom element/lock 355. Slack 331 can then be stored in a way that is aesthetically more pleasing to the eye and in a way whereby the slack 331 may be substantially hidden from someone looking at the cover 320, i.e. away from the user.

Figure 18:
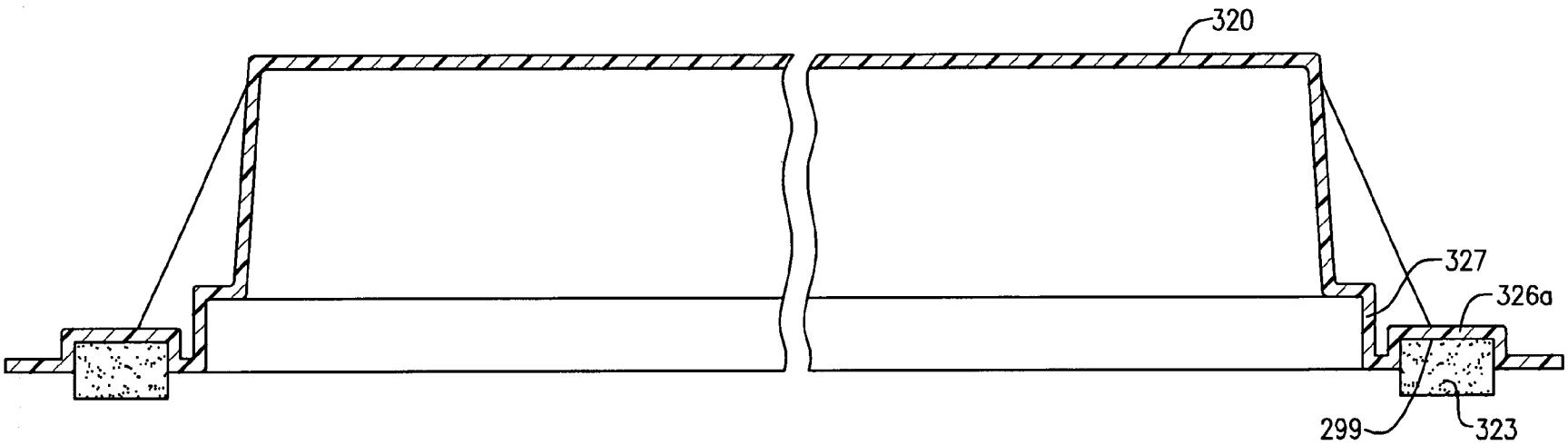
FIG. 18 is a sectional view of the cover of FIG. 13 taken along line 18-18.

A foam 323 or other compressible material 323 may attach to perimeter flange 326*a* for contacting the wall 399 and thereby may override the effect of any irregularities in the surface of the wall 399. Compressible material 323 may thereby seal vent cover 320 against wall 399 when the vent cover 320 may be pressed against wall 399. As seen from FIG. 18, compressible material 323 may lie inside a channel 299 carved into perimeter flange 326*a* although a portion of compressible material 323 may protrude outside the channel 299, to allow compression of this material 323.

Figure 14:
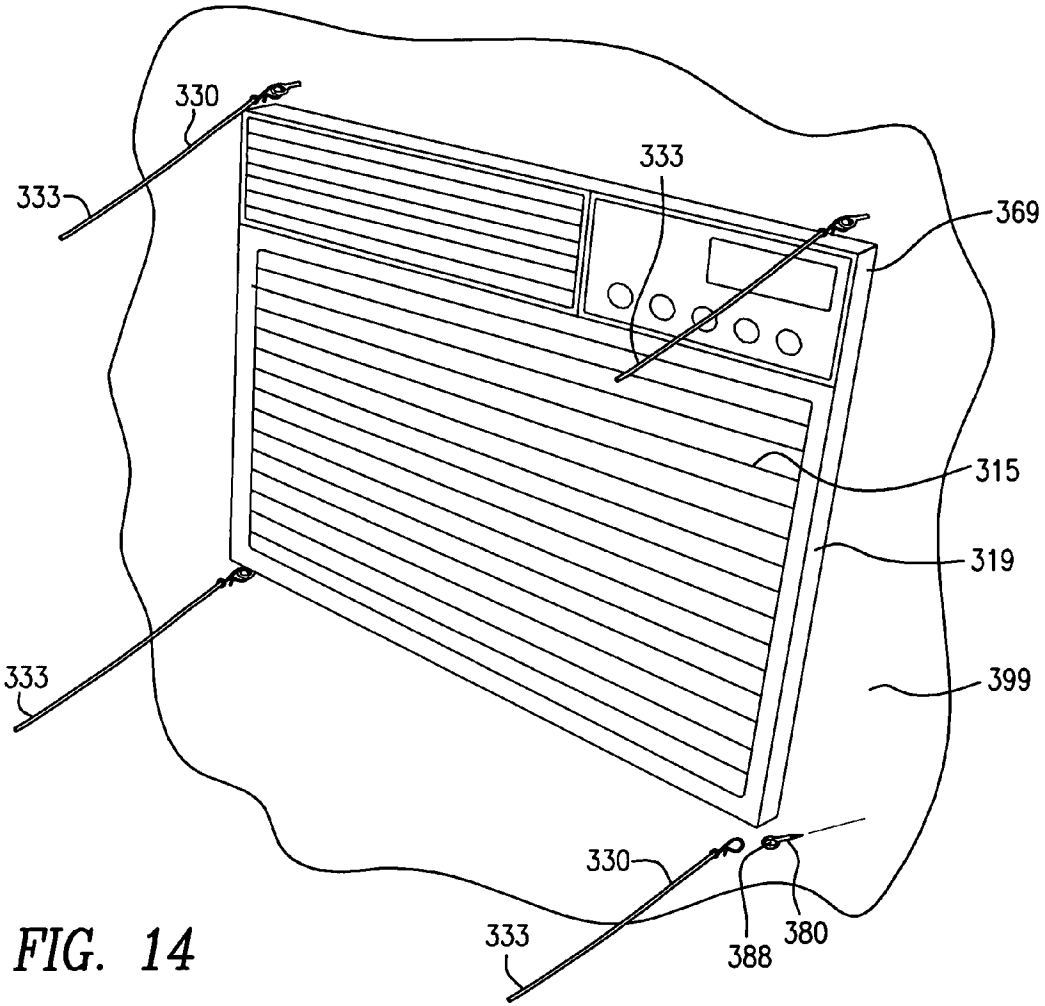
FIG. 14 is a perspective view of four elastic cords and screws adjacent a wall air conditioner and usable with the cover of FIG. 13 as an assembly of the present invention.
Figure 15:
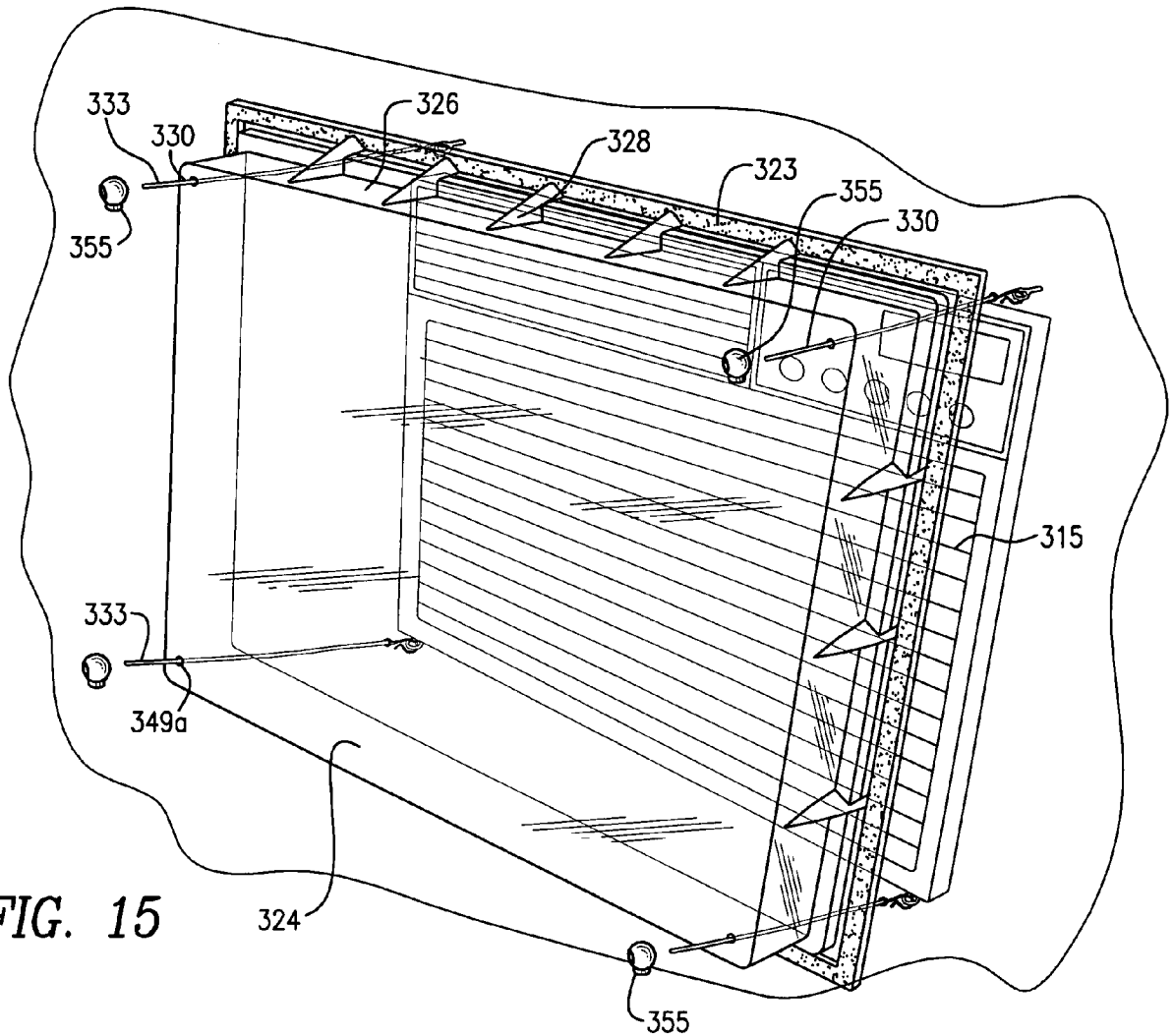
FIG. 15 is a perspective view showing an assembly of the present invention partially installed on a wall air conditioner.
Figure 16:
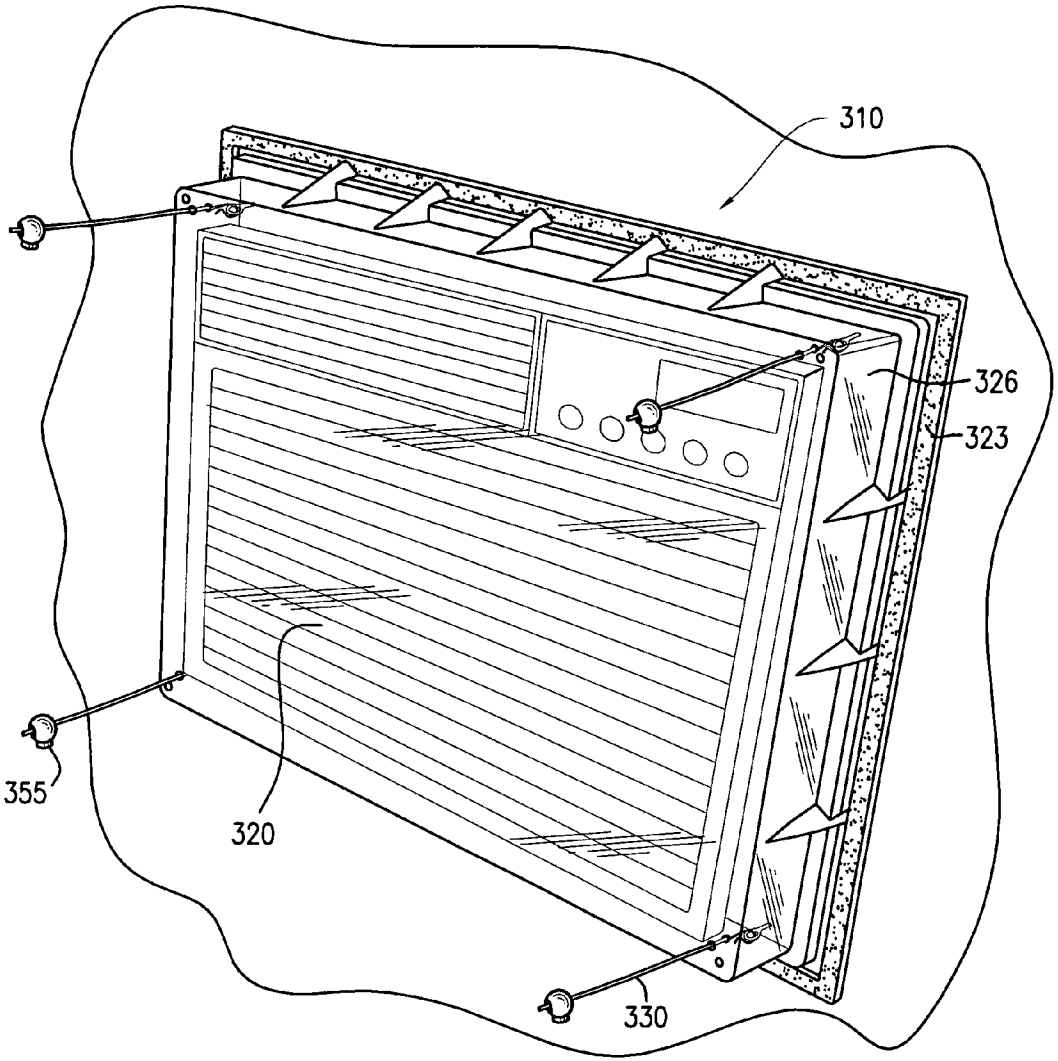
FIG. 16 is a perspective view showing the assembly of FIG. 15 but in a more advanced state of installation on a wall air conditioner.

As seen from FIG. 14 and FIG. 15, assembly 310 may also include fastening structure 380 that can be fastened to the wall 399 securely so that cover 320 does not fall off when cover 320 is in place. An example of fastening structures 380 is eyelet screws 380 that can be screwed into wall 399. Fastening structures 380 may have an aperture at the top that allows a hook to grab it. For example, an eyelet 388 of an eyelet screw 380 may be held by a hook. By way of illustration, eyelet 388 may be ⅝ of an inch in the case of attachment to a wood trim wall and may be one inch for attachment to sheetrock or wall board. As seen from FIG. 14, fastening structures 380 may be situated near the four corners 369 of the air conditioning unit and may be close enough to the air conditioning unit to minimize their conspicuousness. In order to be comfortable enough to grip a top of fastening structure 380 and turn it, a user may be more comfortable using a long and skinny tool that permits the user to manipulate and turn the fastening structure 380 from a point that is away from and does not bump into the air conditioning unit.

Figure 19A:
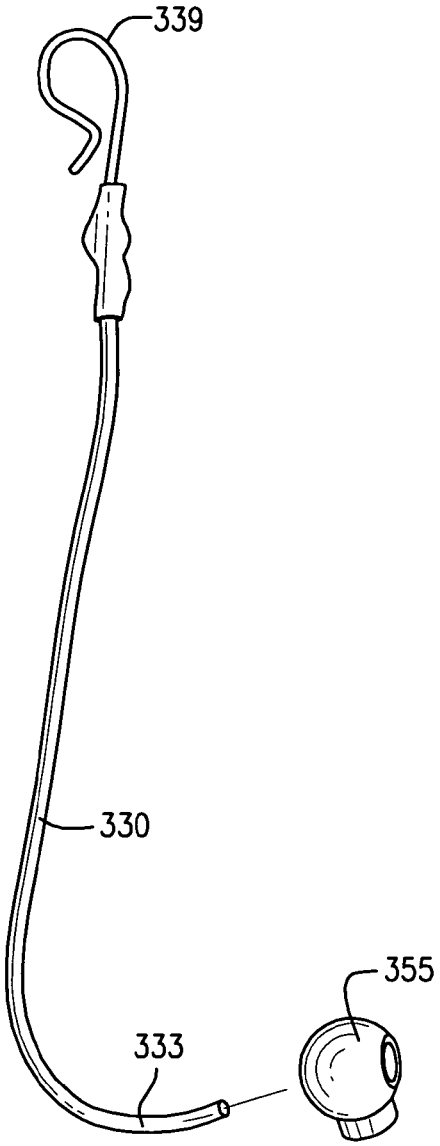
FIG. 19A is a perspective view of an elastic cord used in the assembly of FIG. 15 with the lock detached.
Figure 19B:
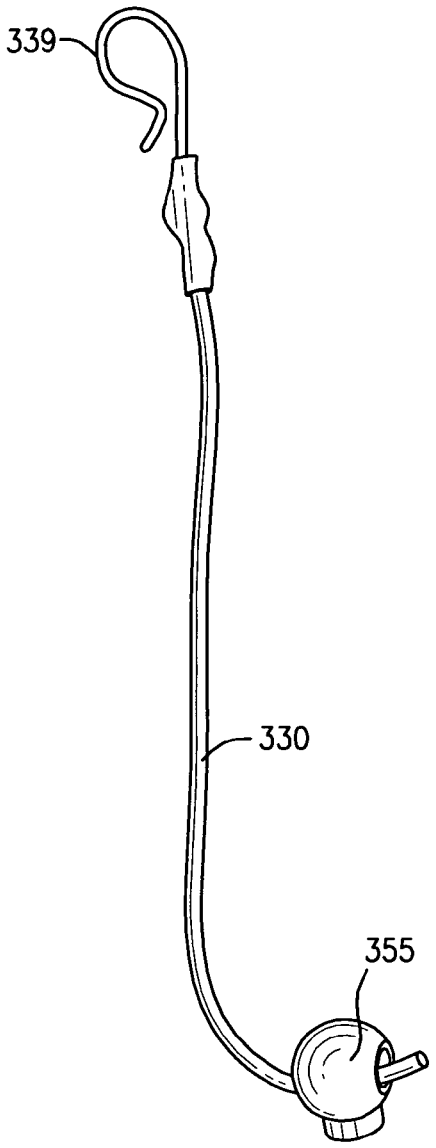
FIG. 19B is a perspective view of an elastic cord used in the assembly of FIG. 15 with the lock attached.
Figure 20:
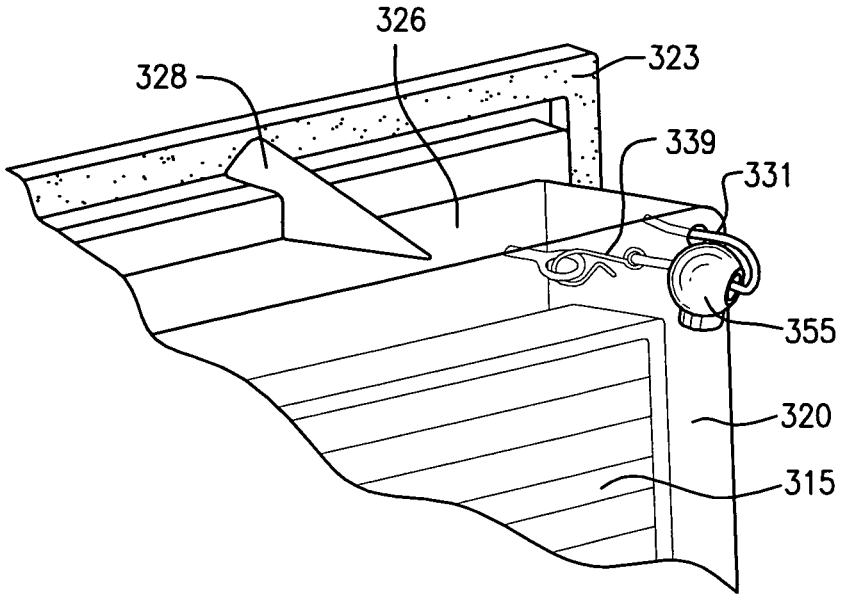
FIG. 20 is enlarged fragmentary perspective view of a corner of the assembly of FIG. 15 fully installed on a wall air conditioner.
Figure 21:
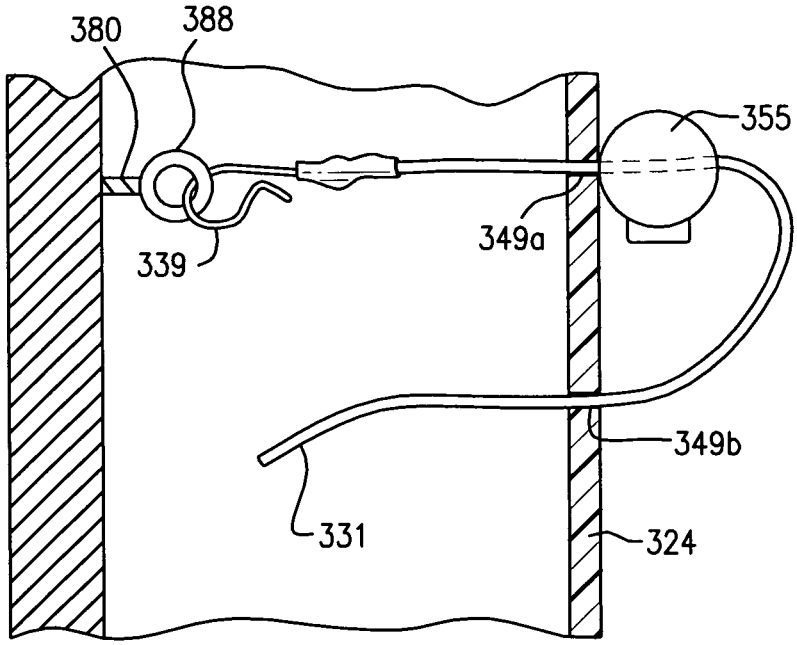
FIG. 21 is a fragmentary view of one corner area of a fully installed assembly of FIG. 15.

As seen from FIG. 19A and FIG. 19B, assembly 310 may also include elastic cords 330 that may be of the same material as the cords 30 that are used for assembly 10. As seen from FIGS. 19A, 19B, each elastic cord 330 may have a free end 33 and may have a hook 339 at a hook end of cord 330. Hook 339 may have the somewhat irregular or bent shape seen in FIG. 19A and FIG. 19B near the end of hook 339 in order to minimize the possibility of inadvertent separation of cord 330 and cover 320 from wall 399. Hook 339 may be attachable to one of the fastening structures 380.

The free end 333 of each elastic cord 330 may extend through the corner aperture 349*a* of cover 320 and may be fitted with a lock 355 that holds the cord sufficiently tight that the cover is urged against the wall. Sliding a bottom element 355 up the cord from below the cover 320 may urge the cover 320 against the wall. In addition, lock 355 may be a barrel lock 355 and may regulate the length of the slack 331 of each elastic cord 330 sticking out of cover 320. A lock 355 associated with a particular may be wider than the aperture 349*a* through which elastic cord 330 fits.

The apparatus of the present invention may also be characterized as an assembly for covering a through-the-wall air conditioner for a wall having fastening structures, the assembly comprising four elastic cords, each having a hook at one end and having a barrel lock at a second end; and a rigid or semi-rigid cover having a perimeter flange to which a flexible sealing material is affixed, having a top and having sides, the top having four corner apertures for insertion of the cords, the barrel locks of the elastic cords collectively urging the cover against the wall so as to create an air-tight seal between the cover and the wall.

Figure 22:
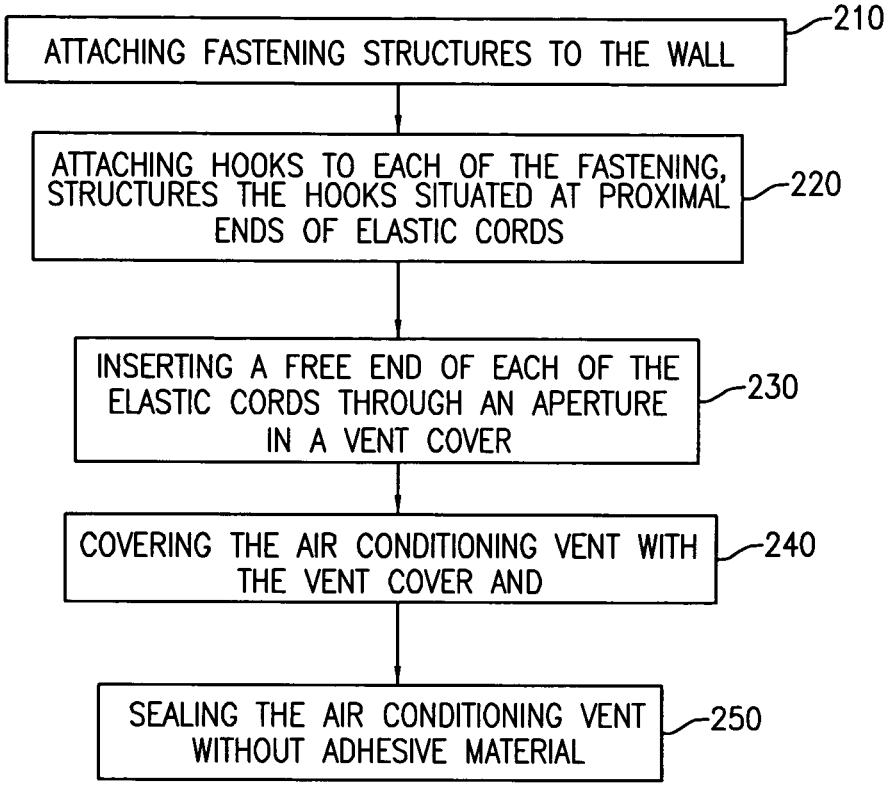
FIG. 22 is a flow chart showing a method of the present invention relating to an assembly of the present invention for wall air conditioners.

As seen from FIG. 22, the present invention may also be characterized as a method 200 of sealing an air conditioning vent of a wall air conditioning unit, i.e. an air conditioning unit that fits into a wall of a building structure. The method 200 may include a step 210 of attaching fastening structures 380 to the wall in a proper position, i.e. adjacent corners of the air conditioning unit. Method 200 may further include a step 220 of attaching each of the hooks on the hook ends of the elastic cords to each of the fastening structures. The hooks may be said to be situated at proximal ends of elastic cords. Method 200 may also include a step 230 of inserting a free end of each of the elastic cords 330 through a corresponding aperture in the cover 320. Step 230 may be performed prior to step 220. Method 200 also may include a step 240 of covering the air conditioning vent with the vent cover and may include a step 250 of sealing the air conditioning vent without adhesive material. Step 240 may be accomplished by pulling, one by one, the free ends of each of the elastic cords 330 while holding the bottom element 355. This may serve to press the cover against the wall. An air-tight seal may be created by the force of the compression acting against the compressible material 323 adjacent perimeter flange 326*a*.

In other respects, the method 200 applicable to wall air conditioning units may be similar to the method 100 applicable to vents on central air conditioning systems. For example, method 200 may be performed whether or not the air conditioning vent is made from metal. In addition, sealing the air conditioning vent may comprise pressing the vent cover against the wall to create an air tight seal using a compressible material around the vent cover. Furthermore, covering the air conditioning vent with the vent cover and sealing the vent cover by pulling the free end of the elastic cord may be carried out in one motion. Moreover, covering the air conditioning vent with the vent cover may be performed by sliding a lock along each of the free ends of the cords to urge the vent cover against the wall. Removing the vent cover from the air conditioning vent may be accomplished by releasing the locks and then either pulling the cover or allowing the weight of the vent cover to cause it to fall away from the wall. This may be accomplished without stripping any paint from the wall.

It should be understood, of course, that the foregoing relates to exemplary embodiments of the invention and that modifications may be made without departing from the spirit and scope of the invention as set forth in the following claims.

We claim:

1. An assembly for covering a vent of an air conditioning unit to completely block air flow, the air conditioning unit fitted through a wall, the assembly comprising:

(a) four fastening structures that can be attached securely to the wall;

(b) four elastic cords, each elastic cord having a U-shaped hook attachable to one of the fastening structures at one end of the elastic cord and having a free end;

(c) a rigid or semi-rigid plastic cover, wherein the cover has a compressible foam along its perimeter for creating an air-tight seal between the cover and the wall, wherein the cover has a top and sides, wherein the top of the cover has two small holes close to each other in each corner of the top of the cover for insertion of the elastic cords, wherein two small holes are used to pass through the elastic cord;

(d) four barrel locks, wherein each of four barrel locks is larger than each of the small holes in each corner of the top of the cover, wherein each of four a barrel locks is slideably attached to the elastic cord, wherein each of four barrel locks holds each of the elastic cords sufficiently tight to control a length of a slack of each elastic cord that projects outside the cover and to urge the cover against the wall.

2. A method of sealing an air conditioning vent for an air conditioning unit that fits into a wall of a building structure, comprising:

(a) attaching four fastening structures of claim 1 to the wall;

(b) attaching each of four U-shaped hooks at one end of four elastic cords of claim 1 to each of the fastening structures of claim 1;

(c) inserting each of free ends of four elastic cords of claim 1 through one hole of two small holes of claim 1 in each corner of the top of the cover of claim 1;

(d) covering the air conditioning vent with the cover of claim 1 by pulling each of four barrel locks of claim 1 up along said free end of said elastic cord to urge said cover against a vent area adjacent the air conditioning vent without adhesive material and locking said cover by said barrel locks; and (e) putting extra elastic cord outside the barrel locks into the other hole of two small holes of claim 1 in each corner of the top of the cover of claim 1.

* * * * *